United States Patent [19]

Madison et al.

[11] Patent Number: 4,822,510

[45] Date of Patent: Apr. 18, 1989

[54] STABLY SUSPENDED 4,4'-SULFONYLBISPEROXYBENZOIC ACID BLEACH IN AN AQUEOUS LIQUID

[75] Inventors: Stephen A. Madison; Leonora M. Ilardi; Patricia Liberati, all of Valley Cottage; Joshua Schwarz, Brooklyn, all of N.Y.

[73] Assignee: Lever Brothers Company, New York, N.Y.

[21] Appl. No.: 173,328

[22] Filed: Mar. 25, 1988

[51] Int. Cl.[4] ..... C11D 3/395

[52] U.S. Cl. ..... 252/95; 252/142; 252/145; 252/173; 252/174.16; 252/174.21; 252/186.23; 252/559; 252/DIG. 14; 8/111

[58] Field of Search ..... 8/111; 252/DIG. 14, 252/95, 540, 142, 145, 559, 173, 186.23, 174.21, 174.16

[56] References Cited

U.S. PATENT DOCUMENTS

| | | | |
|---|---|---|---|
| 3,996,152 | 12/1976 | Edwards et al. | 252/186 |
| 4,017,412 | 4/1977 | Bradley | 252/186 |
| 4,642,198 | 2/1987 | Humphreys et al. | 252/94 |
| 4,655,781 | 4/1987 | Hsieh et al. | 8/111 |
| 4,681,592 | 7/1987 | Hardy et al. | 8/111 |
| 4,758,369 | 7/1988 | Dyroff et al. | 8/111 |

FOREIGN PATENT DOCUMENTS

| | | |
|---|---|---|
| 176124 | 4/1986 | European Pat. Off. . |
| 240481 | 10/1987 | European Pat. Off. . |

*Primary Examiner*—A. Lionel Clingman
*Assistant Examiner*—Van Hoa Le
*Attorney, Agent, or Firm*—Milton L. Honig

[57] ABSTRACT

An aqueous liquid bleaching composition is described having a pH from 1 to 6.5 and comprising 4,4'-sulfonylbisperoxybenzoic acid stably suspended by a surfactant system.

1 Claim, No Drawings

STABLY SUSPENDED 4,4'-SULFONYLBISPEROXYBENZOIC ACID BLEACH IN AN AQUEOUS LIQUID

BACKGROUND OF THE INVENTION

1. Field of the Invention

The invention relates to an aqueous liquid bleaching composition comprising a selected water-insoluble organic peroxy acid, which composition may be used for the bleaching of fabrics and hard surfaces.

2. The Prior Art

Quite a number of organic peroxy acids have been reported in the literature. These peroxy materials have begun to assume great commercial importance as bleaches, especially for fabrics. Many of the more effective organic peroxy acids are solid, substantially water-insoluble materials. Much of the published art has been directed at devising means for stably suspending these acids in water.

One of the early patents in the area is U.S. Pat. No. 3,996,152 (Edwards et al.) disclosing the suspension of diperoxyacids by non-starch thickening agents such as Carbopol 940® in an aqueous media at low pH. Suggested as suitable actives were diperazelaic, diperbrassylic, dipersebacic and diperisophthalic acids. U.S. Pat. No. 4,017,412 (Bradley) reports similar systems except that starch based thickening agents were employed. From later investigations it became evident that the thickener types mentioned in the foregoing patents formed gel-like matrices which exhibited instability upon storage at elevated temperatures. When formulated at high levels, these thickeners became more stable but then caused difficulties with pourability.

U.S. Pat. No. 4,642,198 (Humphreys et al.) lists an even more expansive variety of water-insoluble organic peroxy acids intended for suspension in an aqueous, low pH liquid. Herein was first disclosed the use of surfactants, both anionic and nonionic, as suspending agents for the peroxy acid particles. The preferred peroxy material was identified as 1,12-diperoxydodecanedioic acid (DPDA) and this was employed in almost all the examples.

EP No. 0 176 124 (DeJong et al.) also focuses upon surfactant suspended 1,12-diperoxydodecanedioic acid in a low pH aqueous liquid. This art informs that surfactants other than alkylbenzene sulfonate have a detrimental effect upon chemical stability of the suspensions.

EP No. 0 240 481 (Boyer et al.) seemingly also finds some special significance in the use of alkylbenzene sulfonate, focuses upon DPDA, and further suggests use of magnesium sulfate as a suspension aid.

U.S. Pat. No. 4,655,781 (Hsieh et al.) is concerned with structuring of surface active peroxy acids in substantially nonaqueous media. Of primary interest and illustrated in the examples are alkyl monoperoxysuccinic acid and monocarboxylic fatty peracids.

The aforementioned art has placed great emphasis upon optimizing the suspending or thickening chemical components of the liquid bleach to improve stability. Evidently, there has been little consideration given to examining the peroxy acid itself as a means to improving suspension properties.

Furthermore, while the use of surfactants and electrolytes have provided a certain measure of chemical and physical stability, this stability is only evident at lower temperatures. At slightly elevated temperatures, instability problems still remain.

Consequently, it is an object of the present invention to provide an improved aqueous liquid bleach composition based upon a solid, substantially water-insoluble organic peroxy acid wherein the above drawbacks are mitigated.

More specifically, it is an object of the present invention to provide an aqueous suspension of a solid, substantially water-insoluble organic peroxy acid which is chemically and physically stable throughout a wide range of temperatures.

These and other objects of the present invention will become apparent as further details are provided in the subsequent discussion and Examples.

SUMMARY OF THE INVENTION

An aqueous liquid bleaching composition having a pH of from 1 to 6.5 is herein provided comprising:

(i) from 1 to 40% by weight of 4,4'-sulfonylbisperoxybenzoic acid; and (ii) from 2 to 50% by weight of a surfactant.

DETAILED DESCRIPTION OF THE INVENTION

Now it has been discovered that not all water-insoluble organic peroxy acids have equal stability when suspended in low pH water. It has been found that 4,4'-sulfonylbisperoxybenzoic acid (SBPB), whose structure is outlined below, is both chemically and physically more stable in aqueous structured liquid than the benchmark acid DPDA.

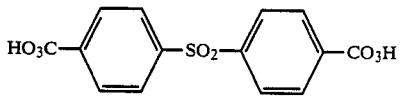

SBPB

SBPB is commercially available from the Monsanto Company. Amounts of this acid to be used for compositions of this invention range from about 1 to about 40% by weight, preferably from about 2 to 30%, optimally between about 2 and 10% by weight.

The particle size of the peroxy acid used in this invention is of some importance. Particles that are too large have been found to readily separate while very small particle sizes decrease chemical stability. The range of particle size should be from about 20 to 1,000 microns, preferably between 20 and 500 microns, optimally between 30 and 250 microns.

Surfactants are required to stably suspend the sulfonyl diperacid of the present invention. Suitable for this purpose are anionic, nonionic, cationic, zwitterionic or mixed surfactants thereof. However, the preferred system is a mixed anionic and nonionic detergent combination.

Nonionic surfactants useful for the present invention may be selected from a wide category of materials, many of which are outlined in Schwartz, Perry, Vol. II, 1958 "Detergents and Surface Agents" and Schick, Vol. I, 1967 "Nonionic Surfactants", herein incorporated by reference. For instance, fatty acids, fatty alcohols, fatty amides and alkoxylated derivatives thereof may be usefully employed. Within the alkoxylate category, there is recommended ethylene oxide and/or propylene oxide condensation products of $C_8$–$C_{20}$ linear- or branched-chain aliphatic carboxylic acids, aliphatic alcohols and alkyl phenols. Especially preferred, however, are the $C_{12}$–$C_{18}$ aliphatic alcohols ethoxylated with an average from about 3 to about 12 moles of ethylene oxide per alcohol molecule. Even more specifically the $C_{12}$–$C_{15}$ alcohols condensed with either an average of 3 or 9 moles ethylene oxide and the $C_{12}$–$C_{14}$ aliphatic alcohols condensed with 7 moles ethylene oxide have been found to be highly effective.

Anionic surfactants which may be useful for the present invention can be found listed in Schwartz, Perry, Vol. II, 1958 "Detergents and Surface Active Agents", herein incorporated by reference.

Examples of anionic materials are water-soluble salts of alkylbenzene sulfonates, alkyl sulfates, alkyl ether sulfates, dialkyl sulfosuccinates, paraffin sulfonates, α-olefin sulfonates, α-sulfocarboxylates and their esters, alkyl glycerol ether sulfonates, fatty acid monoglyceride sulfates and sulfonates, alkyl phenol polyethoxy ether sulfates, 2-acyloxy-alkane-1-sulfonates, β-alkoxyalkane sulfonates, secondary alkane sulfonates, and mixtures thereof.

The cationic detergents which can be used in the present invention include quaternary ammonium salts which contain at least one alkyl group having from 12 to 20 carbon atoms. Although the halide ions are the preferred anions, other suitable anions include acetate, phosphate, sulfate, nitrite and the like.

Specific cationic detergents include distearyl dimethyl ammonium chloride, stearyl dimethyl benzyl ammonium chloride, stearyl trimethyl ammonium chloride coco dimethyl benzyl ammonium chloride, dicoco dimethyl ammonium chloride, cetyl pyridinium chloride, cetyl trimethyl ammonium bromide, stearyl amine salts that are soluble in water such as stearyl amine acetate and stearyl amine hydrochloride, stearyl dimethyl amine hydrochloride, distearyl amine hydrochloride, alkyl phenoxyethoxyethyl dimethyl ammonium chloride, decyl pyridinium bromide, pyridinium chloride derivative of the acetyl amino ethyl esters of lauric acid, lauryl trimethyl ammonium chloride, decyl amine acetate, lauryl dimethyl ethyl ammonium chloride, the lactic acid and citric acid and other acid salts of stearyl-1-amidoimidazoline with methyl chloride, benzyl chloride, chloroacetic acid and similar compounds, mixtures of the foregoing, and the like.

Zwitterionic detergents include alkyl-β-iminodipropionate, alkyl-β-aminopropionate, fatty imidazolines, betaines, and mixtures thereof.

Specific examples of such detergents are 1-coco-5-hydroxyethyl-5-carboxymethyl imidazoline, dodecyl-β-alanine, the inner salt of 2-trimethylamino lauric acid, and N-dodecyl-N,N-dimethyl amino acetic acid.

The total surfactant amount in the liquid bleaching composition of the invention may vary from 2 to 50% by weight, preferably from 5 to 35% by weight, depending on the purpose of use. In the case of suspending liquids comprising an anionic and a nonionic surfactant, the ratio thereof may vary from about 10:1 to 1:10. The term anionic surfactant used in this context includes the alkali metal soaps of synthetic or natural longchain fatty acids having normally from 12 to 20 carbon atoms in the chain.

The total level of electrolyte(s) present in the composition to provide structuring may vary from about 1 to about 30%, preferably from 1.5 to 25% by weight. Examples of electrolytes include inorganic compounds such as sodium sulfate and sodium nitrate.

Since most commercial surfactants contain metal ion impurities (e.g. iron and copper) that can catalyze peroxy acid decomposition in the liquid bleaching composition of the invention, those surfactants are preferred which contain a minimal amount of these metal ion impurities. The peroxy acid instability results in fact from its limited, though finite, solubility in the suspending liquid base and it is this part of the dissolved peroxy acid which reacts with the dissolved metal ions. It has been found that certain metal ion complexing agents can remove metal ion contaminants from the composition of the invention and so retard the peroxy acid decomposition and markedly increase the lifetime of the composition.

Examples of useful metal ion complexing agents include dipicolinic acid, with or without a synergistic amount of a water-soluble phosphate salt; dipicolinic acid N-oxide; picolinic acid; ethylene diamine tetraacetic acid (EDTA) and its salts; various organic phosphonic acids or phosphonates such as hydroxyethylidenediphosphonic acid (Dequest 2010®), ethyl diamine tetra-(methylene phosphonic acid), and diethylene triamine penta-(methylene phosphonic acid).

Other metal complexing agents known in the art may also be useful, the effectiveness of which may depend strongly on the pH of the final formulation. Generally, and for most purposes, levels of metal ion complexing agents in the range of from about 10–1000 ppm are already effective to remove the metal ion contaminants.

In addition to the components discussed above, the liquid bleaching compositions of the invention may also contain certain optional ingredients in minor amounts. Typical examples of optional ingredients are suds-controlling agents, fluorescers, perfumes, coloring agents, abrasives, hydrotropes and antioxidants. However, any such optional ingredient should only be incorporated if its presence in the composition does not significantly reduce the chemical and physical stability of the peroxy acid in the suspending system.

Aqueous liquid products encompassed by the invention will have a viscosity in the range of from about 50 to 20,000 centipoises (0.05 to 20 Pascal seconds) measured at a shear rate of 21 second$^{-1}$ at 25° C. In most cases, however, products will have a viscosity of from about 0.2 to about 12 PaS, preferably between about 0.5 and 1.5 PaS.

Also of importance is that the aqueous liquid bleaching compositions of this invention have an acid pH in the range of from 1 to 6.5, preferably from 2 to 5.

The following Examples will more fully illustrate the embodiments of this invention. All parts, percentages and proportions referred to herein and in the appended claims are by weight of the total composition unless otherwise stated.

EXAMPLE 1

In a typical formulation, SBPB is incorporated at about 0.549% active oxygen level (5.8% as SBPB) in a lamellar phase surfactant structured liquid base. The pH of this formulation is adjusted to 4–4.5 with an appropriate mineral acid. The composition is outlined below.

| Ingredients | Weight % |
|---|---|
| Sodium alkylbenzene sulfonate | 7.0 |
| $C_{14}$–$C_{15}$ primary alcohol/7 moles ethylene oxide | 3.0 |
| Sodium sulfate | 7.0 |
| SBPB | 5.8 |

-continued

| Ingredients | Weight % |
|---|---|
| Dequest 2010 ® | 0.04 |
| Fluorescer | 0.2 |
| Water + 10% sulfuric acid to adjust pH 4–4.5 | balance |

The sulfonyl diperacid (ex Monsanto) was obtained as a 50% mixture where the other component was essentially boric acid, present as an exotherm control agent. The boric acid was removed by washing repeatedly with distilled water and collecting the diperacid on a filter. Efficiency of the washing was gauged by performing an iodometric titration on a sample of the wet diperacid cake.

Sodium alkylbenzene sulfonate was added to a beaker containing water. The mixture was then stirred vigorously until it became homogeneous. At that point, the fluorescer and Dequest ® were added sequentially with vigorous stirring following each addition. The pH of the mixture was adjusted to 4.5 with dilute sulfuric acid. At the desired pH, the diperacid was introduced and dispersed by stirring. This step was followed by the sequential addition of Neodol 45-7 ® (ethoxylated alcohol) and sodium sulfate. Thereafter, the mixture was homogenized using a Ross Homogenizer for 20 minutes. This ensured that a particle size sufficient to maintain adequate suspension of diperacid was achieved. The formulation was analyzed by iodometric titration to assess active oxygen content. A successful preparation was marked by the formation of a thick creamy opaque liquid.

EXAMPLE 2

This Example illustrates the greater chemical and physical stability of the SBPB formulation against a correspondingly formulated DPDA system at relatively elevated temperatures. Active oxygen was assessed by iodometric titration. Formulas, identical to that of Example 1 except with different diperacids, were stored at 40°, 45° and 50° C. Table I provides data on the % decrease in chemical reactivity at the three temperatures. Additionally, asterisks indicate which of the suspensions became destructured, i.e. precipitation of peracid particles and separation from suspension. Half-life (in days) for the structured liquid bleach are summarized in Table II.

TABLE I

| | Relative % Decrease in Activity at 40° C. | | | |
|---|---|---|---|---|
| | Days | | Weeks | |
| | 6 | 13 | 4 | 14 |
| DPDA | 10 | 19.4 | 33.3 | 67.6 |
| SBPB | 6 | 8.5 | 14.2 | 38.8 |

| | Relative % Decrease in Activity at 45° C. | | | | |
|---|---|---|---|---|---|
| | Days | | Weeks | | |
| | 6 | 13 | 4 | 7 | 10 |
| DPDA | 39* | 60* | 77* | 80* | 81.5* |
| SBPB | 10 | 12 | 22.5 | 40 | 49 |

| | Relative % Decrease in Activity at 50° C. | | | | |
|---|---|---|---|---|---|
| | Days | | Weeks | | |
| | 6 | 13 | 4 | 8 | 12 |
| DPDA | 71.1* | 75.2* | — | — | — |
| SBPB | 16.2 | 23.3 | 36.9 | 57 | 73.8 |

*Destructured

TABLE II

| Bleach Stability Half-Life at Elevated Temperature | | | |
|---|---|---|---|
| | Temperature (°C.) | | |
| Diperacid | 40 | 45 | 50 |
| DPDA | 52 days | 10 days | 6–7 days |
| SBPB | >100 days | 70 days | 45 days |

From Tables I and II, it is seen that at each temperature, the SBPB formulation was chemically more stable. Further, the physical stability of the SBPB formulation, as indicated by the absence of phase separation, was markedly greater than that of the DPDA structured liquid. For example, the DPDA formulation destructured at 45° and 50° C. after only 6 and ½ days, respectively. However, the SBPB formulation maintains structure throughout the half-life determinations (greater than 14 weeks).

EXAMPLE 3

Under this Example is recorded the bleaching ability of SBPB formulations. In terms of stain bleaching ability, the SBPB formulation was essentially equal to that of the DPDA system. Common stains such as tea, red wine and spaghetti sauce were used in this evaluation. Typically, stained cotton test pieces were washed in a Terg-o-tometer in a 1 liter of aqueous solution containing a given level of structured liquid bleach and surfactant (1.5 gms/liter). Washes were conducted at 40° C. for 15 minutes. Stain bleaching was measured using a Colorgard System/05 Reflectometer and is indicated by an increase in reflectance, reported as $\Delta\Delta R$ (i.e. the difference in the $\Delta R_{observed}$ less $\Delta R_{surfactant\ alone}$) for tea and wine stains and as $\Delta\Delta b$ for spaghetti sauce stain.

TABLE II

| | Bleach Performance | | |
|---|---|---|---|
| Peroxyacid | pH | | Stain Type |
| | | $\Delta\Delta R$ | |
| SBPB | 8 | 8.1 | Tea |
| | 9 | 6.9 | Tea |
| | 10 | 3.8 | Tea |
| DPDA | 8 | 9.6 | Tea |
| | 9 | 7.2 | Tea |
| | 10 | 2.6 | Tea |
| SBPB | 9 | 7.9 | Wine |
| | 10 | 7.6 | Wine |
| DPDA | 9 | 8.0 | Wine |
| | 10 | 5.9 | Wine |
| | | $\Delta\Delta b$ | |
| SBPB | 9 | 1.2 | Spaghetti Sauce |
| DPDA | 9 | 1.4 | Spaghetti Sauce |

The foregoing description and examples illustrate selected embodiments of the present invention and in light thereof various modifications will be suggested to one skilled in the art, all of which are within the spirit and purview of this invention.

What is claimed is:

1. An aqueous liquid bleaching composition having a pH from 4 to 4.5 consisting essentially of:

(i) 7% of sodium alkylbenzene sulfonate;

(ii) 3% of $C_{14}$–$C_{15}$ primary alcohol condensed with 7 moles ethylene oxide;

(iii) 7% of sodium sulfate;

(iv) 5.8% of 4,4'-sulfonylbisperoxybenzoic acid;

(v) 0.04% of hydroxyethylidenediphosphonic acid;

(vi) 0.2% of fluorescer; and wherein said 4,4'-sulfonylbisperoxybenzoic acid has a particle size ranging from 30 to 250 microns.

* * * * *